United States Patent [19]

DeBold et al.

Best Available Copy

[11] Patent Number: 4,487,744

[45] Date of Patent: Dec. 11, 1984

[54] CORROSION RESISTANT AUSTENITIC ALLOY

[75] Inventors: Terry A. DeBold, Wyomissing; Douglas G. Frick, Pottstown; John S. Kutzamanis, Reading, all of Pa.

[73] Assignee: Carpenter Technology Corporation, Reading, Pa.

[21] Appl. No.: 402,638

[22] Filed: Jul. 28, 1982

[51] Int. Cl.[3] ..... C22C 30/00

[52] U.S. Cl. ..... 420/584; 420/582; 420/583; 228/263.11; 428/678; 219/146.23

[58] Field of Search ..... 420/582, 584, 586, 583; 75/128 G, 128 N, 128 T, 128 W; 219/129, 146.23, 146.41; 228/263.14, 263.11; 428/678, 679

[56] References Cited

U.S. PATENT DOCUMENTS

| | | | |
|---|---|---|---|
| T967,001 | 2/1978 | Brown et al. | 420/582 |
| 3,168,397 | 2/1965 | Scharfstein | 75/128 |
| 3,547,625 | 12/1970 | Bieber et al. | 75/128 |
| 3,859,082 | 1/1975 | Denhard, Jr. et al. | 75/128 |
| 4,201,575 | 5/1980 | Henthorne et al. | 75/122 |
| 4,248,629 | 2/1981 | Pons et al. | 420/584 |

OTHER PUBLICATIONS

H. L. Black & L. W. Lherbier, "Development of a Modified Alloy 20 Stainless Steel" *A.S.T.M. Special Technical Publication No.* 369, (1963).

*Primary Examiner*—L. Dewayne Rutledge
*Assistant Examiner*—Debbie Yee
*Attorney, Agent, or Firm*—Edgar N. Jay

[57] ABSTRACT

An austenitic stainless corrosion resistant alloy and articles made therefrom having good resistance to pitting and crevice corrosion in oxidizing chloride-bearing media combined with resistance to general corrosion and to intergranular corrosion in oxidizing media, containing in weight percent about

| | w/o |
|---|---|
| C | 0.06 Max. |
| Mn | 1.4 Max. |
| Si | 0.9 Max. |
| P | 0.035 Max. |
| S | 0.035 Max. |
| Cr | 20–26 |
| Ni | 34–44 |
| Mo | 3–<5.1 |
| Cu | 0.1–<3.1 |
| N | 0.4 Max. |
| B | 0.005 Max. |
| Ce + La | 0.4 Max. Added |
| Nb | 1 Max. |
| Ti | 0.5 Max. |

and the balance iron. The amount of nitrogen is not greater than that which can be retained in solution. When present niobium plus titanium ranges upward from a minimum which is sufficient to combine stoichiometrically with the amount of carbon present in excess of 0.025 w/o. In this composition the elements chromium, nickel, molybdenum and copper are balanced so that the value of Correlation I is equal to or less than 1.6021 and that of Correlation II is equal to or less than 5.

Correlation I:

1.6021 is equal to or greater than the value of $7.0011-0.2269(\%Cr)-0.0769(\%Ni)-0.046(\%Mo)+0.03(\%Cu)+0.0017(\%Ni)^2+0.0486(\%Mo)^2-0.0066(\%Ni)(\%Mo)$.

Correlation II:

5 is equal to or greater than the value of $14.7182-0.3759(\%Cr)+0.0986(\%Ni)-1.2976(\%Mo)+0.02(\%Cu)-0.0165(\%Cr)(\%Mo)-0.0202(\%Cr)(\%Cu)+0.0223(\%Ni)(\%Cu)$.

22 Claims, No Drawings

CORROSION RESISTANT AUSTENITIC ALLOY

This invention relates to an austenitic stainless alloy and, more particularly, to a chromium-molybdenum-nickel-copper-iron alloy containing controlled amounts of other metallic and non-metallic elements balanced to provide a unique combination of good mechanical and general corrosion properties combined with outstanding pitting and crevice corrosion resistance.

Industrial development has resulted in an increasing demand for relatively low cost alloys for use in making articles having good mechanical properties, good corrosion resistance and good fabricability. The following is representative of alloys which have been developed in recent years.

U.S. Pat. No. 3,168,397, granted Feb. 2, 1965 to L. R. Scharfstein (assigned to the assignee of the present application), relates to a chromium-molybdenum-nickel-copper-iron alloy sold commercially as 20Cb-3 (trademark of Carpenter Technology Corporation stainless steel alloy containing 0.06 weight percent (w/o) Max. carbon, 2 w/o Max. manganese, 1 w/o Max. silicon, 0.035 w/o Max. each of phosphorus and sulfur, 19-21 w/o chromium, 32.5-38 w/o nickel, 2-3 w/o molybdenum, 3-4 w/o copper, w/o niobium equal to about 8 times w/o carbon but not to exceed 1 w/o and the balance iron plus small amounts of other elements such as misch metal and/or boron to enhance workability. Though specifically designed to provide outstanding resistance to sulfuric acid-bearing media at relatively low cost, the alloy has been widely used because of its good resistance to corrosion in a wide range of applications. Typical uses for 20Cb-3 stainless alloy include mixing tanks, heat exchangers, process piping, metal cleaning and pickling tanks, pumps, valves, fittings, fasteners and others. Nevertheless, its resistance to pitting and crevice corrosion in oxidizing chloride-bearing media has left something to be desired.

In an article published by H. L. Black and L. W. Lherbier, "Development of a Modified Alloy 20 Stainless Steel", *A.S.T.M. Special Technical Publication* No. 369 (1963), the authors explored the effects of variations of various alloying elements in the stainless 20 steel types or series of alloys of which 20Cb-3 stainless alloy is an example. Their finding of a beneficial effect of increasing nickel content up to 30-35 w/o with a leveling off with further increases in nickel content to about 50 w/o confirms a similar previous statement (circa 1962) in the U.S. Pat. No. 3,168,397 to the effect that increasing nickel above 35 w/o added unnecessarily to the cost of the composition. Black and Lherbier also concluded that increasing niobium 0-1.5 w/o had a slight detrimental effect and increasing chromium 15-22 w/o a significant detrimental effect on corrosion resistance in sulfuric acid. The authors also concluded that the following elements in the ranges indicated had no effect on corrosion resistance in sulfuric acid: carbon 0.01-0.11 w/o, cooper 1.5-4 w/o, molybdenum 2-6 w/o, titanium 0-1.5 w/o, boron 0.0009-0.005 w/o, and calcium 0.05 w/o added.

INCOLOY (trademark of International Nickel Company, Inc.) Alloy 825 is another alloy which has received wide commercial acceptance in providing wrought products requiring good general corrosion resistance and resistance to oxidizing chemical and pitting attack. Alloy 825 is broadly described as containing 0.05 w/o Max. carbon, 1.0 w/o Max. manganese, 0.5 w/o Max. silicon, 19.5-23.5 w/o chromium, 1.5-3.0 w/o copper, 2.5-3.5 w/o molybdenum, 38.0-46.0 w/o nickel, 0.6-1.2 w/o titanium, 0.2 w/o Max. aluminum, 0.03 w/o Max. sulfur and the remainder iron plus incidental impurities. Nevertheless, Alloy 825 has left much to be desired insofar as its resistance to pitting and crevice corrosion in oxidizing chloride-bearing media is concerned.

U.S. Pat. No. 3,547,625, granted December 15, 1970 to C. G. Bieber and R. A. Covert, relates to a chromium-molybdenum-nickel-bearing stainless steel described as having enhanced resistance to corrosion media, particularly chloride environments and which broadly contains 20-40 w/o nickel, 6-12 w/o molybdenum, 14-21 w/o chromium, up to 0.2 w/o carbon, up to 0.5 w/o silicon, up to 1 w/o manganese up to 0.7 w/o titanium, up to 0.7 w/o aluminum, up to 0.15 w/o calcium, up to 12 w/o cobalt and at least 30 w/o iron. The alloy is intended for marine applications where resistance is required to corrosion, including crevice, pitting, intergranular and stress corrosion cracking, especially in chloride media. Though theoretically embracing an extremely large number of alloys of wide ranging compositions and properties, the patent testifies to the complexity of such alloys and the care required in balancing the elements within their stated ranges. Thus, with regard to compositions containing 35-40 w/o nickel that are characterized as being resistant to crevice and pitting corrosion in chloride media as well as resistant to stress corrosion cracking, it is stated that more than 9 w/o, e.g. 9.5 w/o, and up to 12 w/o molybdenum together with 14 w/o to not more than 19 w/o chromium should be present.

U.S. Pat. No. 3,859,082, granted Jan. 7, 1975 to E. E. Denhard, Jr. and R. R. Gaugh, relates to wrought products characterized as having resistance to intergranular corrosion, excellent resistance to stress corrosion cracking in the presence of chlorides and containing 0.06-0.30 w/o carbon, 3-12 w/o manganese, 1.0 w/o Max. silicon, 0.030 w/o Max. each phosphorus and sulfur, 15-25 w/o chromium, up to 4 w/o molybdenum, 25-35 w/o nickel, up to 0.7 w/o columbium plus vanadium, up to 0.007 w/o boron, up to 0.03 w/o nitrogen, the remainder iron. The minimum carbon content is described as essential to attaining useful stress corrosion resistance.

U.S. Pat. No. 4,201,575, granted May 6, 1980 to M. Henthorne and T. DeBold (assigned to the assignee of the present application), relates to an austenitic stainless corrosion-resistant alloy available commercially as 20Mo-6 (trademark of Carpenter Technology Corporation) alloy for parts requiring good general corrosion resistance and good resistance to pitting and crevice corrosion in the presence of chlorides. As disclosed in the patent, the alloy is balanced to provide those properties within the following broad range: 0.06 w/o Max. carbon, 1.00 w/o Max. manganese, 0.50 w/o Max. silicon, 0.03 w/o Max. each of phosphorus and sulfur, 22-26 w/o chromium, 32.5-37 w/o nickel, 5-6.7 w/o molybdenum, 1.0-4 w/o copper, 0.005 w/o Max. boron, 1 w/o Max. niobium, 0.4 w/o Max. nitrogen, 0.4 w/o Max. added cerium plus lanthanum (added as misch metal), and the balance iron plus incidental impurities.

In general, the more highly alloyed compositions have proven successful in applications having extremely exacting requirements where high cost was tolerable or could not be avoided. In the case of such compositions, high cost may result from the use of larger proportions of expensive alloying ingredients, difficulties in production or fabricability or both as well as one or more additional factors. For example, nickel base alloys are necessarily more expensive than iron base alloys because of the much greater cost of nickel. While efforts to provide less expensive alloys to meet specific or narrow requirements such as outstanding pitting and crevice corrosion resistance to oxidizing chloride media have proven successful, as in the case of the 20Mo-6 brand stainless alloy, such alloys lack the general resistance to corrosion in a relatively broad spectrum of corrosive media characteristic of an alloy such as the 20Cb-3 brand stainless alloy.

BRIEF SUMMARY OF THE INVENTION

It is, therefore, a principal object of this invention to provide an austenitic stainless alloy with good mechanical properties, good corrosion resistance and good pitting and crevice corrosion resistance to oxidizing chloride-bearing media combined with relatively low cost.

It is a more specific object to provide such an alloy with good pitting and crevice corrosion resistance with no significant sacrifice in general or intergranular corrosion resistance in oxidizing media including chloride-bearing media and having resistance to sulfuric acid.

Another object is to provide such an alloy which has good intergranular corrosion resistance in the sensitized or as-welded condition.

The foregoing, as well as additional objects and advantages, are attained by providing a stainless alloy and products made therefrom in which the elements Cr, Ni, Mo, Cu are balanced within the broad ranges stated in weight percent in Table 1 so that the values of Correlation I and Correlation II between the elements Cr, Ni, Mo and Cu do not exceed the values indicated.

TABLE I

| | w/o |
|---|---|
| Chromium | 20–26 |
| Nickel | 34–44 |
| Molybdenum | 3–to less than 5.1 |
| Copper | 0.1–to less than 3.1 |

Correlation I 1.6021 is equal to or greater than the value of $7.0011 - 0.2269\,(\%\ Cr) - 0.0769\,(\%\ Ni) - 0.046\,(\%\ Mo) + 0.03\,(\%\ Cu) + 0.0017\,(\%\ Ni)^2 + 0.0486\,(\%\ Mo)^2 - 0.0066\,(\%\ Ni)\,(\%\ Mo)$ Correlation II 5 is equal to or greater than the value of $14.7182 - 0.3759\,(\%\ Cr) + 0.0986\,(\%\ Ni) - 1.2976\,(\%\ Mo) + 0.02\,(\%\ Cu) - 0.0165\,(\%\ Cr)\,(\%\ Mo) - 0.0202\,(\%\ Cr)\,(\%\ Cu) + 0.0223\,(\%\ Ni)\,(\%\ Cu)$ The balance of the composition is iron plus small amounts, that is from a trace up to several percent, said up to about 2 or 3 percent, of elements which are beneficial or which are tolerable.

DETAILED DESCRIPTION

In this composition, carbon and nitrogen, though strong austenite formers, are not considered essential but may be present, preferably in amounts which do not require stabilization. However, above about 0.03 w/o, carbon increasingly detracts from intergranular, pitting and crevice corrosion resistance. While up to about 0.06 w/o carbon is tolerable, better yet no more than about 0.03 w/o or preferably no more than about 0.025 w/o carbon is present. Because of the cost involved in reducing the amount of carbon below about 0.010 w/o, that is a practical but not essential minimum for carbon. As the amount of carbon present is increased above about 0.025 w/o, to facilitate making the alloy and fabricating articles therefrom the carbon is stabilized with up to about 1 w/o niobium. Good results are provided with an amount of niobium equal to from about 10 times the weight percent of carbon in excess of 0.025 w/o to about 10 times the total weight percent carbon. For best intergranular corrosion resistance, the larger amounts of niobium contemplated can be used when the carbon content is greater than about 0.03 w/o, that is the amount of niobium required to combine stoichiometrically with the available carbon or a minimum of about 10 times the total amount of carbon present, up to a maximum of 1 w/o. For best pitting and crevice corrosion resistance no more than about 0.3 w/o niobium is best used when the carbon content is equal to or less than about 0.04 w/o. In other words, when carbon is equal to or less than about 0.04 w/o, niobium plus titanium should be such that $$\frac{w/o\ Nb}{10} + \frac{w/o\ Ti}{5}$$

is equal to or less than 0.03. While a preferred composition of the present invention does not require the presence of a stabilizer such as niobium or titanium, it is to be noted that in the commercial production of such alloys with a carbon aim of about 0.025 w/o or less some small percentage of the heats produced may inadvertently contain carbon in an amount somewhat greater than 0.025 w/o. It, therefore, may be desirable in order to avoid resorting to more expensive melting practices, to routinely include up to about 0.3 w/o niobium, that is, about 0.2–0.3 w/o niobium in all heats.

An equivalent amount of titanium may be used to replace all or part of the niobium, that is, in the ratio of their atomic weights or an amount of titanium equal to about one half the amount of niobium replaced. Thus, when used alone, up to about 0.5 w/o titanium is used. Commercial niobium-bearing alloy additives usually include some tantalum. The amount stated for niobium is intended as including the accompanying tantalum, if any.

Nitrogen, like carbon, is about 30 times as effective as nickel in stabilizing austenite in this composition with the result that small amounts may be beneficial. Because of its tendency to impair the resistance of the composition to sulfuric acid, nitrogen is preferably limited to 0.05 w/o. As nitrogen is increased above 0.1 w/o, it is believed to reduce, and, above about 0.2 w/o, severely impair the foregeability of the composition. However, larger amounts up to about 0.4 w/o, but not in excess of its solubility in the composition, can be used as when the composition is to be used in the form of a casting or when powder metallurgy techniques are used and resistance to corrosion in sulfuric acid is not required.

Such elements as manganese, silicon, phosphorus and sulfur are desirably kept low. For good results, manganese is kept to a maximum of about 1.4 w/o, preferably about 0.5 w/o Max.; silicon about 0.9 w/o Max., preferably about 0.4 w/o Max.; phosphorus about 0.035 w/o Max., preferably about 0.025 w/o Max.; sulfur about 0.035 w/o Max., preferably about 0.005 w/o Max. In the case of manganese and silicon, when one of them is present in the larger amounts of up to the broad maximum, the other should be kept to no more than its preferred maximum. For best results in a composition, manganese, silicon, phosphorus and sulfur are controlled so as not to exceed the stated preferred maximum.

Up to about 0.005 w/o boron may be present, and, because of its beneficial effect on intergranular corrosion resistance, preferably a small but effective amount, e.g. 0.0005 w/o or better yet 0.0015–0.0035 w/o boron, is preferably present.

Small amounts of one or more other elements may also be present because of their beneficial effect in refining and deoxidizing the melt. Misch metal (a mixture of rare earths primarily comprising cerium and lanthanum) may be used and is preferred because it may have a beneficial effect upon the composition's forgeability, but for that effect no definite amount of misch metal need be retained in the composition; its beneficial effect being provided during the melting process when, if used, up to about 0.4 w/o, preferably no more than about 0.3 w/o, may be added if desired. Such elements as magnesium, calcium and/or aluminum may also be added to the melt, as is known, to aid in refining and deoxidation and may also benefit foregeability as measured by high temperature ductility. When added, the amount should be adjusted so that the amount retained in the composition does not undesirably affect corrosion resistance or other desired properties of the composition.

For some purposes, optional elements such as carbon, manganese, silicon, phosphorus, sulfur, cerium plus lanthanum, nitrogen, oxygen, as well as others, are best kept low as will be more fully pointed out hereinbelow with regard to the use of the present invention to provide weld filler material.

The elements chromium, nickel, molybdenum and copper when carefully balanced within their stated ranges so as to maintain the values of Correlation I and Correlation II provide the unique combination of general corrosion resistance, resistance to intergranular corrosion, good pitting and crevice corrosion resistance and good resistance to sulfuric acid depending upon the concentration and temperature.

Nickel, and to some extend copper, work to stabilize the austenitic balance of this composition. For this purpose, at least about 34 w/o, or better yet at least about 36 w/o, preferably a minimum of about 37 w/o, nickel is present. As the amount of nickel present in this composition is increased over its range, the minimum amounts of chromium and molybdenum must also be adjusted upwards if the desired corrosion resistance properties of this composition are to be attained. Therefore, nickel is limited to a maximum of about 44 w/o, preferably to no more than about 42 w/o. Copper over its range has a similar but smaller effect. Also, increasing nickel tends to decrease the solubility of carbon and nitrogen thereby leading to increased carbide or carbonitride formation when the composition is subjected to elevated temperatures.

In this composition, copper is not essential to the attainment of its pitting and crevice corrosion resistance as measured in room temperature ferric chloride (ASTM G-48), but from about 0.15 w/o to about 1.5 w/o copper has a beneficial effect upon resistance to pitting and crevice corrosion in oxidizing chloride-bearing media and preferably for that effect 0.2–0.7 w/o copper is used. Copper also is not essential to the attainment of the intergranular corrosion resistance of this composition (as measured in boiling 65 w/o $HNO_3$, ASTM A262-C.). However, in this composition unless a surprisingly small but effective amount of copper is present, resistance to sulfuric acid cannot be assured. The beneficial effect of as little as 0.1 w/o copper on corrosion resistance to boiling sulfuric acid is readily demonstrated. When consistently good resistance to sulfuric acid-bearing media is not required as little as about 0.1 w/o copper may be present in this composition. However, when the use for which the composition is intended may result in exposure to sulfuric acid-bearing media, then depending upon the acid temperature and concentration, 0.20 w/o copper or better yet with about 0.4 w/o copper present, good corrosion resistance to sulfuric acid is provided. For best results, a minimum of about 0.5 w/o copper is preferred. To maintain the desired maximum crevice corrosion weight loss of about 5 milligrams per square centimeter and maximum intergrannular corrosion rate of about 1 millimeter per year as the amount of copper present is increased from 0.5 w/o, the minimum amounts of chromium and/or molybdenum required at a given level of nickel are increased in keeping with Correlations I and II. In addition, as the amount of nickel present is increased the minimum amounts of chromium and/or molybdenum required are also greater. Thus, copper is limited to a maximum of 3.1 w/o, better yet to less than 3.0 or to about 2 w/o, and preferably to no more than about 1.5 w/o.

Chromium contributes to the intergranular corrosion resistance (as measured in 65 w/o boiling nitric acid, ASTM A262-C and in ferric sulfate plus sulfuric acid, ASTM A262-B) and to the pitting and crevice corrosion resistance as measured in room temperature ferric chloride (ASTM G-48). To that end, a minimum of about 20 w/o chromium and up to about 26 w/o, preferably up to about 24 w/o is present in this composition. Molybdenum also contributes significantly to corrosion resistance in oxidizing chloride-bearing media, and, for that purpose, a minimum of about 3 w/o molybdenum is present. At the lower levels of chromium and molybdenum called for, the minimum amounts of chromium and molybdenum should not be used together. And as noted hereinabove, the minimum amounts of chromium and molybdenum must be adjusted upward when the amounts of nickel and copper present increase within their stated ranges. In addition, the minimum amounts of chromium and molybdenum must be adjusted relative to each other. Thus, at about 20 w/o chromium with low nickel and low copper, a minimum of about 3.5 w/o or even 3.7 w/o molybdenum would be better, and, with about 3 w/o molybdenum, a minimum of about 22.5 w/o chromium should be present. Those minimum values are adjusted upward as nickel and/or copper increase. With about 42 w/o nickel and about 2.0–3.1 w/o copper, a minimum of about 21.5 w/o chromium is to be balanced with a minimum of about 4.3 w/o molybdenum, and a minimum of about 24 w/o chromium is to be balanced with a minimum of about 3.4 w/o molybdenum.

For best results, the elements chromium, molybdenum, nickel and copper are balanced to provide articles for which the value of Correlation I does not exceed 1.6021 and the value of Correlation II does not exceed 5. In this way, articles are consistently provided having good intergranular corrosion resistance as measured by exposure to 65 w/o boiling nitric acid after being sensitized at 1400° F. (760° C.) for one hour and in accordance with ASTM A262-C, and good pitting and crevice corrosion resistance in room temperature 10 w/o $FeCl_3 \cdot 6H_2O$ when tested in accordance with ASTM G-48. Thus, the composition is balanced so that the value of Correlation I does not exceed 1.6021, that is:

$$7.0011-0.2269(\%Cr)-0.0769(\%Ni)-0.046(\%Mo)+0.03(\%Cu)+0.0017(\%Ni)^2+0.0486(\%Mo)^2-0.0066(\%Ni)(\%Mo)$$

is not greater than 1.6021; and the composition is also balanced so that Correlation II does not exceed 5, that is:

$$14.7182-0.3759(\%Cr)+0.0986(\%Ni)-1.2976(\%Mo)+0.02(\%Cu)-0.0165(\%Cr)(\%Mo)-0.0202(\%Cr)(\%Cu)+0.0223(\%Ni)(\%Cu)$$

is not greater than 5.

No special techniques are required in melting, casting and working this composition. In general, arc melting with argon-oxygen decarburization is preferred together with misch metal deoxidation. Other practices can be used. In some instances an initial ingot cast as an electrode may be remelted or powder metallurgy techniques may be used to provide better control of unwanted constituents or phases. Good hot workability is attained by hot working from a furnace temperature of about 2300° F. (about 1260° C. preferably from about 2250° F. (about 1230° C.), reheating as necessary. Annealing is carried out above about 1900° F. (about 1035° C.) preferably at about 1950° F. (about 1065° C.) for a time depending upon the dimensions of the article which is then preferably quenched in water.

This composition is suitable for forming to a great variety of shapes and products for a wide variety of uses. It lends itself to the formation of billets, bars, rod, wire, strip, plate or sheet using conventional practices. To that end, the composition is advantageously balanced to contain 0.025 w/o Max. C, 0.5 w/o Max. Mn, 0.4 w/o Max. Si, 0.025 w/o Max. P, 0.005 w/o Max. S, 22.5–24 w/o Cr, 37–43 w/o Ni, better yet 37–41.5 w/o Ni, 3.5–<5.1 w/o Mo, better yet 3.5–4.5 w/o Mo, 0.5–1.5 w/o Cu, 0.05 w/o Max. N, 0.0015–0.0035 w/o B, 0.4 w/o Max. Ce+La (added), 0.2–0.3 w/o Nb, and the balance essentially iron. And a further exemplary analysis of this invention contained 0.023 w/o C, 0.30 w/o Mn, 0.36 w/o Si, 0.024 w/o P, 0.004 w/o S, 23.46 w/o Cr, 37.59 w/o Ni, 3.76 w/o Mo, 1.16 w/o Cu, 0.0017 w/o B, 0.035 w/o N, 0.27 w/o Nb and the balance essentially iron.

The composition is advantageously used in the manufacture of tubing for use in heat exchangers or condensers. Because of its good weldability by conventional welding techniques, this composition is suitable for the manufacture of welded tubing for which gas tungsten arc welding is preferred. In the case of autogeneously welded tubing, or other welded members, which are not to be annealed before use, most consistent pitting resistance as measured in the $FeCl_3$ test is provided by using the larger amounts of chromium, nickel and molybdenum specified. Thus, for use in the as-welded (unannealed) condition 22.5–26 w/o chromium, 38–44 w/o nickel and 4–5 molybdenum are preferably balanced with the remaining elements as pointed out hereinabove. For some purposes, it may be useful to provide this alloy in the form of a weld filler wire, rod or other material with the larger amount of Cr, Ni and Mo just stated. Plate or sheet formed from this composition is well suited for the manufacture of tube sheets, plate coils, tanks and other products for use in chemical process piping and equipment, mixing tanks, metal cleaning and pickling tanks.

A preferred composition for weld filler wire characterized by enhanced freedom from weld hot cracking contains about 0.015 w/o Max. carbon, 0.5 w/o Max. manganese, 0.20 w/o Max. silicon, 0.020 w/o Max. phosphorus, 0.005 w/o Max. sulfur, 22.5–24 w/o chromium, 41.5–43 w/o nickel, 4.5–<5.1 w/o molybdenum, 0.5–2 w/o copper, 0.05 w/o Max. nitrogen, 0.0015–0.0035 w/o boron, 0.03 w/o Max. added cerium plus lanthanum, 0.3 w/o Max. niobium, and the balance essentially iron. A composition particularly well suited for use as a weld filler material, in wire or other form, contains about 0.015 w/o C, about 0.45 w/o Mn, about 0.1 w/o Si, about 0.01 w/o P, about 0.001 w/o S, about 23 w/o Cr, about 42 w/o Ni, about 4.9 w/o Mo, about 1 w/o Cu, about 0.01 w/o N, about 0.002 w/o B, about 0.25 w/o Nb, with the balance essentially iron.

Example 1–44 of present invention were prepared as small, experimental heats containing the amounts of chromium, nickel, molybdenum and copper indicated. The values of Correlations I and II for each example are indicated respectively under "Cor. I" and "Cor. II" respectively. In addition, each example contained 0.025 w/o or less carbon, 0.040 w/o or less nitrogen, between 0.35–0.50 w/o manganese, 0.25–0.35 w/o silicon, less than 0.03 w/o phosphorus, less than 0.003 w/o sulfur, less than 0.075 w/o cerium plus lanthanum, 0.001–0.005 w/o boron and the balance iron except for small inconsequential amounts of impurities usually found in stainless alloys. It is to be noted that the amounts of the optional elements are stated here solely for purposes of examplification and not by way of limitation.

TABLE II

| Ex. No. | Cr | Ni | Mo | Cu | Cor. I | Cor. II |
|---|---|---|---|---|---|---|
| 1 | 25.84 | 37.32 | 3.45 | 0.64 | 0.2250 | 2.9 |
| 2 | 23.02 | 37.12 | 3.52 | 1.92 | 0.9012 | 4.6 |
| 3 | 25.80 | 37.32 | 4.98 | 1.93 | 0.4524 | 0.8 |
| 4 | 25.64 | 42.21 | 3.46 | 2.09 | 0.4878 | 4.2 |
| 5 | 23.04 | 37.64 | 4.90 | 0.60 | 1.0295 | 1.8 |
| 6 | 22.91 | 41.44 | 4.66 | 1.89 | 1.1586 | 3.3 |
| 7 | 23.04 | 42.09 | 3.64 | 0.60 | 1.0316 | 4.4 |
| 8 | 25.91 | 43.58 | 2.96 | 1.54 | 0.4840 | 4.9 |
| 9 | 23.99 | 33.94 | 3.00 | 1.61 | 0.5817 | 4.4 |
| 10 | 24.06 | 39.02 | 2.98 | 1.47 | 0.7008 | 5.1 |
| 11 | 23.93 | 38.95 | 2.98 | 0.55 | 0.7001 | 4.7 |
| 12 | 22.02 | 39.06 | 3.91 | 0.57 | 1.1670 | 4.1 |
| 13 | 23.76 | 39.01 | 3.82 | 0.52 | 0.7627 | 3.4 |
| 14 | 20.11 | 34.08 | 3.87 | 1.43 | 1.5141 | 4.7 |
| 15 | 22.14 | 34.20 | 3.86 | 1.46 | 1.0550 | 3.8 |
| 16 | 23.90 | 34.10 | 3.74 | 1.58 | 0.6461 | 3.2 |
| 17 | 24.09 | 39.36 | 3.72 | 1.47 | 0.7211 | 3.8 |
| 18 | 24.49 | 43.64 | 3.94 | 1.51 | 0.8097 | 3.9 |
| 19 | 26.35 | 43.82 | 3.90 | 1.56 | 0.3955 | 3.1 |
| 20 | 24.40 | 33.80 | 3.09 | 2.89 | 0.5293 | 4.4 |
| 21 | 21.03 | 34.45 | 4.00 | 2.83 | 1.3668 | 4.7 |
| 22 | 21.99 | 33.89 | 3.94 | 2.95 | 1.1384 | 4.2 |
| 23 | 24.08 | 34.08 | 3.86 | 2.89 | 0.6561 | 3.3 |
| 24 | 23.82 | 39.12 | 3.78 | 3.01 | 0.8245 | 4.5 |
| 25 | 23.89 | 43.81 | 3.76 | 2.90 | 0.9882 | 5.2 |
| 26 | 26.27 | 43.65 | 3.79 | 2.98 | 0.4441 | 4.0 |
| 27 | 20.93 | 38.99 | 4.57 | 0.48 | 1.4813 | 3.4 |
| 28 | 21.85 | 39.33 | 5.01 | 0.59 | 1.3551 | 2.3 |
| 29 | 23.97 | 38.96 | 4.82 | 0.55 | 0.8312 | 1.6 |
| 30 | 21.34 | 38.51 | 4.74 | 1.37 | 1.4290 | 3.3 |
| 31 | 21.92 | 39.24 | 5.06 | 1.38 | 1.3700 | 2.6 |
| 32 | 23.65 | 33.77 | 4.91 | 1.41 | 0.8704 | 1.3 |
| 33 | 23.91 | 38.91 | 4.86 | 1.29 | 0.8725 | 1.9 |
| 34 | 24.30 | 43.85 | 4.73 | 1.46 | 0.9288 | 2.6 |
| 35 | 25.98 | 43.90 | 4.63 | 1.54 | 0.5401 | 2.0 |
| 36 | 21.48 | 33.95 | 5.00 | 2.87 | 1.4267 | 2.7 |
| 37 | 21.64 | 39.23 | 4.76 | 2.98 | 1.4296 | 3.9 |
| 38 | 22.65 | 38.19 | 4.60 | 2.91 | 1.1490 | 3.5 |

TABLE II-continued

| Ex. No. | Cr | Ni | Mo | Cu | Cor. I | Cor. II |
|---|---|---|---|---|---|---|
| 39 | 21.60 | 43.95 | 4.83 | 2.90 | 1.6016 | 4.6 |
| 40 | 23.07 | 44.11 | 4.41 | 2.98 | 1.2300 | 4.6 |
| 41 | 23.78 | 33.75 | 4.91 | 2.66 | 0.8783 | 1.6 |
| 42 | 23.84 | 39.02 | 4.94 | 2.76 | 0.9489 | 2.4 |
| 43 | 24.12 | 43.99 | 4.81 | 3.04 | 1.0339 | 3.4 |
| 44 | 25.43 | 43.62 | 4.79 | 2.98 | 0.7164 | 2.7 |

Material from each of Examples 1–44 was processed into 0.125 in (0.32 cm) thick strip from which standard corrosion 1.5×0.5×0.125 in (3.81×1.27×0.32 cm) specimens were prepared and tested in nitric acid, sulfuric acid, and ferric sulfate - sulfuric acid. The results are set forth in Table III. Additional duplicate cold rolled annealed (CRA) and machine ground coupons 2×1×0.125 in (5.08×2.54×0.32 cm) were prepared from Examples 1–44, those from Examples 1–7 were tested for 72 hours at room temperature (RT) with and, at 30° C., without crevices in 10 w/o $FeCl_3 . 6H_2O$ (6 w/o $FeCl_3$) according to ASTM G48. The duplicate coupons prepared from Examples 8–44 with crevices were tested at room temperature under the same conditions. The crevice corrosion weight loss in milligrams per square centimeter (mg/cm$^2$) is given in Table III as an average of two tests and the pitting weight loss is given in Table IIIA. Because the crevice corrosion test is a more severe test than the pitting test and because the weight lost from pitting alone by the annealed test specimens of Examples 1–7 in Table IIIA was small compared to the weight lost from crevice corrosion by Examples 1–7 (Table III), separate pitting tests were not considered necessary, and were dispensed with in the case of Examples 8–44. Standard machine-ground duplicate samples of Examples 8–37, 39 and 41–44 prepared as described and provided with a longitudinal gas-tungsten arc weld were exposed to 10 w/o $FeCl_3 . 6H_2O$ at 40° C. for 72 hours and then the weight lost was measured. The results as averages of two tests are also set forth in Table III in mg/cm$^2$.

Further corrosion tests were carried out using standard cold rolled annealed and machine-ground duplicate samples of Examples 1–44 prepared as was described, sensitized by heating for one hour at 1400° F. (760° C.), cooling in air were then exposed to boiling (Blg) nitric acid (65 w/o $HNO_3$) for five periods of 48 hours each according to ASTM A262-C. The average corrosion rate was determined and is set forth in Table III in millimeters per year (mmpy). Standard cold rolled annealed and machine-ground duplicate samples of Examples 1–44 were exposed to boiling 10 w/o $H_2SO_4$ for three periods of 48 hours each, the average corrosion rate was determined and the results in millimeters per year are also set forth in Table III. Another set of similarly prepared specimens was subjected to a similar test in boiling 30 w/o $H_2SO_4$ with the resulting corrosion rates shown in Table III. Yet another set of similarly prepared specimens of certain of the examples after being sensitized by heating for one hour at 1250° F. (about 676.7° C.), air cooled, was exposed to boiling ferric sulfate-sulfuric acid for 120 hours (ASTM A262-B) after which the corrosion rate in millimeters per year was determined and set forth in Table III.

TABLE III

| | 6 w/o $FeCl_3$ (72 hrs) Weight Loss (mg/cm$^2$) | | Corrosion Rate (mmpy) - Blg. | | | |
|---|---|---|---|---|---|---|
| Ex. No. | CRA RT Crev. | As-welded 40 C Pitting | 65 w/o $HNO_3$ | 10 w/o $H_2SO_4$ | 30 w/o $H_2SO_4$ | $Fe_2(SO_4)_3$—$H_2SO_4$ |
| 1 | 3.05 | — | 0.093 | 1.534 | 2.031 | 0.155 |
| 2 | 4.75 | — | 0.152 | 1.104 | 1.124 | 0.192 |
| 3 | 0.6 | — | 0.122 | 0.945 | 3.404 | 0.189 |
| 4 | 4.0 | — | 0.094 | 0.770 | 0.899 | 0.156 |
| 5 | 1.85 | — | 0.193 | 1.053 | 1.469 | 0.231 |
| 6 | 2.85 | — | 0.395 | 0.677 | 0.925 | 0.279 |
| 7 | 4.2 | — | 0.224 | 0.790 | 1.043 | 0.207 |
| 8 | 4.45 | 0.85 | 0.100 | 0.650 | 0.560 | — |
| 9 | 4.15 | 11.5 | 0.107 | 1.949 | 1.835 | — |
| 10 | 3.70 | 14.15 | 0.198 | 0.933 | 0.563 | 0.191 |
| 11 | 4.5 | 2.75 | 0.122 | 0.701 | 0.982 | — |
| 12 | 3.75 | 6.95 | 0.385 | 0.326 | 0.898 | — |
| 13 | 3.10 | 2.7 | 0.137 | 0.607 | 0.999 | — |
| 14 | 3.35 | 11.9 | 0.244 | 0.775 | 0.611 | 0.286 |
| 15 | 3.5 | 7.25 | 0.133 | 1.260 | 0.876 | — |
| 16 | 2.05 | 3.55 | 0.094 | 2.769 | 5.715 | 0 211 |
| 17 | 3.25 | 11.15 | 0.166 | 0.640 | 0.899 | — |
| 18 | 4.0 | 5.05 | 0.136 | 0.371 | 0.406 | 0.201 |
| 19 | 5.15 | 0.95 | 0.098 | 0.467 | 0.526 | — |
| 20 | 4.70 | 6.40 | 0.123 | 0.505 | 1.543 | — |
| 21 | 4.05 | 10.85 | 0.747 | 1.542 | 1.289 | — |
| 22 | 4.3 | 12.9 | 0.314 | 1.416 | 1.228 | 0.307 |
| 23 | 4.45 | 23.4 | 0.135 | 1.407 | 2.511 | — |
| 24 | 3.0 | 18.7 | 0.118 | 1.861 | 1.748 | 0.265 |
| 25 | 4.0 | 4.0 | 0.116 | 0.794 | 0.599 | — |
| 26 | 4.55 | 0.7 | 0.083 | 0.509 | 0.502 | — |
| 27 | 3.55 | <0.1 | 0.409 | 0.732 | 0.836 | — |
| 28 | 2.85 | 0.9 | 0.787 | 0.544 | 0.671 | — |
| 29 | 2.2 | <0.1 | 0.155 | 0.714 | 1.165 | — |
| 30 | 2.9 | <0.1 | 0.433 | 0.505 | 0.485 | — |
| 31 | 3.05 | 3.1 | 0.787 | 0.544 | 0.671 | — |
| 32 | 0.7 | 7.75 | 0.160 | 1.034 | 4.699 | — |
| 33 | 1.7 | 0.3 | 0.157 | 0.729 | 0.960 | 0.348 |
| 34 | 1.5 | 1.0 | 0.137 | 0.513 | 0.508 | — |
| 35 | 1.5 | 7.7 | 0.107 | 0.481 | 0.644 | — |
| 36 | 2.55 | 12.7 | 0.813 | 1.096 | 1.433 | — |
| 37 | 3.65 | 24.1 | 0.676 | 3.378 | 0.433 | 0.255 |
| 38 | 3.7 | — | 0.465 | 0.779 | 0.538 | — |
| 39 | 3.95 | 10.8 | 0.406 | 0.331 | 0.343 | — |
| 40 | 4.2 | — | 0.183 | 0.362 | 0.362 | — |
| 41 | 1.15 | 1.75 | 0.187 | 1.295 | 3.874 | — |
| 42 | 2.3 | 2.25 | 0.203 | 0.612 | 0.594 | — |
| 43 | 3.65 | 1.75 | 0.146 | 0.368 | 0.544 | — |
| 44 | 3.55 | 0.6 | 0.112 | 0.485 | 0.513 | — |

TABLE IIIA

| Ex. No. | Wt. Loss (mg/cm$^2$) 30 C Pitting |
|---|---|
| 1 | .85 |
| 2 | .5 |
| 3 | .3 |
| 4 | 1.6 |
| 5 | <.1 |
| 6 | <.1 |
| 7 | 1.3 |

From the compositions and data set forth thus far, it is apparent that the compositions of the present invention are characterized by an outstanding combination of resistance to pitting and crevice corrosion resistance in 6 w/o $FeCl_3$ with resistance to corrosion as measured in boiling nitric acid. In addition, depending upon the balance maintained among the elements Cr, Mo, Ni and Cu, good resistance to sulfuric acid is also attained. Such properties are provided without the mandatory addition of such stabilizing elements as niobium, titanium or the like.

The effect of cooper on the room temperature (RT) crevice corrosion resistance of this composition in 6 w/o ferric chloride (10 w/o $FeCl_3 . 6H_2O$) and in sulfuric acid is demonstrated by Heat 601 and Examples 45–51 in which copper was the only element intentionally varied and in which the remaining elements do not differ significantly. The chemical analyses of the eight compositions are set forth in Table IV. In those eight compositions, the manganese range was 0.34–0.38 w/o, the silicon range was 0.32–0.33 w/o, the phosphorus range was 0.010–0.017 w/o, the sulfur range was 0.001–0.002 w/o and the nitrogen range was 0.031–0.036 w/o.

TABLE IV

| Heat or Ex. No. | C | Cr | Ni | Mo | Cu | B |
|---|---|---|---|---|---|---|
| Ht. 601 | .028 | 23.38 | 37.89 | 3.77 | <.01 | .0023 |
| Ex. 45 | .028 | 23.31 | 37.97 | 3.76 | .10 | .0025 |
| Ex. 46 | .023 | 22.80 | 38.14 | 3.76 | .20 | .0032 |
| Ex. 47 | .022 | 22.83 | 38.04 | 3.77 | .29 | .0034 |
| Ex. 48 | .019 | 23.37 | 37.88 | 3.75 | .39 | .0019 |
| Ex. 49 | .022 | 23.40 | 38.05 | 3.76 | .48 | .0025 |
| Ex. 50 | .026 | 23.28 | 38.05 | 3.75 | 1.43 | .0027 |
| Ex. 51 | .029 | 23.22 | 38.09 | 3.75 | 2.70 | .0025 |

Material from each of the eight compositions was processed as described in connection with Examples 1–44 and duplicate specimens of Heat 601 and Exs. 45–51 were tested with crevices in 6 w/o $FeCl_3$ in accordance with ASTM G48. The average weight loss of the duplicate specimens was determined and set forth in Table V. Duplicate cold rolled annealed and machine ground specimens of Heat 601 and Examples 45–51 were tested in boiling 10 w/o sulfuric acid for three successive 48 hour periods and the average corrosion rate for each pair was determined and is set forth in Table V in millimeters per year (mmpy). Another set of duplicate specimens of Heat 601 and Examples 45–51 was similarly tested in boiling 30 w/o sulfuric acid and the corrosion rate is also set forth in Table V in mmpy. For convenient reference, the copper content of the eight compositions is repeated in Table V. In the case of the duplicate specimens of Heat 601, the test in 30 w/o $H_2SO_4$ was discontinued after the first period and the corrosion rate indicated is that measured after the first 48 hour period.

TABLE V

| Heat or Ex. No. | Cu | Wt. Loss (mg./cm²) CRA, RT Crevice | Corrosion Rate (mmpy) Blg. 10 w/o $H_2SO_4$ | 30 w/o $H_2SO_4$ | Cor. II |
|---|---|---|---|---|---|
| Ht. 601 | <.01 | 5.40 | 2.604 | 64.059 | — |
| Ex. 45 | .10 | 5.45 | 1.001 | 2.569 | 3.4 |
| Ex. 46 | .20 | 3.65 | 0.809 | 1.697 | 3.7 |
| Ex. 47 | .29 | 3.60 | 0.673 | 1.433 | 3.7 |
| Ex. 48 | .39 | 3.35 | 0.768 | 1.204 | 3.5 |
| Ex. 49 | .48 | 3.25 | 0.833 | 0.631 | 3.5 |
| Ex. 50 | 1.43 | 4.60 | 0.753 | 0.630 | 4.0 |
| Ex. 51 | 2.70 | 5.55 | 0.723 | 0.632 | 4.5 |

The effect of the presence of small amounts of copper is most clearly shown by the corrosion rate in boiling 30 w/o $H_2SO_4$ where the presence of 0.10 w/o copper in Example 45 has resulted in about a 25 times reduction in corrosion rate as compared to less than 0.01 w/o copper in Heat 601. The data in Table V also demonstrates that the addition of 0.20 w/o copper significantly improves crevice corrosion resistance in room temperature 6 w/o $FeCl_3$ and only very little more than 0.10 w/o copper, e.g. about 0.15 w/o, is required for its effect to be beneficial. It is also apparent that when as little as about 0.10 w/o copper is present or as much as about 2.5 w/o or more copper is present, larger amounts of chromium and/or molybdenum and/or a lower amount of nickel than the amounts thereof shown in Examples 45–51 should be present within their stated ranges, as indicated by Correlation II. Heats 602–617, the compositions of which are set forth in Table VI, are within the range set forth in Table I and demonstrate that good crevice corrosion resistance as measured by the test in room temperature 6 w/o $FeCl_3$for 72 hours is not assured unless in balancing the alloy the value of Correlation II is maintained equal to or less than 5. The compositions set forth in Table VI were prepared and formed into test specimens as described in connection with Examples 1–44. Each contained amounts of carbon, nitrogen, manganese, silicon, phosphorus, sulfur, cerium plus lanthanum, boron and the balance iron as indicated in connection with Examples 1–44. Cold rolled annealed and machine ground duplicate test specimens were prepared as previously described and were tested in 6 w/o $FeCl_3$ at room temperature with crevices as set forth in ASTM G48. The results are set forth in Table VI as the average of two tests.

TABLE VI

| Heat No. | Cr | Ni | Mo | Cu | Cor. I | Cor. II | Wt. Loss (mg/cm²) CRA, RT Crevice |
|---|---|---|---|---|---|---|---|
| 602 | 20.08 | 33.98 | 3.06 | 1.44 | 1.4660 | 6.1 | 5.4 |
| 603 | 22.17 | 34.14 | 3.02 | 1.47 | 0.9947 | 5.2 | 5.95 |
| 604 | 20.31 | 33.86 | 3.05 | 2.94 | 1.4564 | 6.5 | 6.65 |
| 605 | 21.84 | 33.92 | 3.13 | 2.87 | 1.1106 | 5.6 | 5.15 |
| 606 | 19.99 | 39.13 | 3.00 | 0.55 | 1.6004 | 6.4 | 5.7 |
| 607 | 22.04 | 39.10 | 3.12 | 0.59 | 1.1345 | 5.4 | 5.3 |
| 608 | 20.27 | 38.87 | 3.18 | 1.38 | 1.5520 | 6.4 | 5.4 |
| 609 | 21.84 | 39.00 | 3.04 | 1.47 | 1.2031 | 6.0 | 8.05 |
| 610 | 20.56 | 38.77 | 3.08 | 2.83 | 1.5261 | 7.1 | 6.6 |
| 611 | 20.64 | 38.70 | 3.84 | 2.80 | 1.5311 | 5.8 | 5.25 |
| 612 | 21.80 | 39.15 | 3.01 | 2.92 | 1.2614 | 6.7 | 6.15 |
| 613 | 20.05 | 43.69 | 3.01 | 1.40 | 1.8129 | 7.4 | 9.65 |
| 614 | 20.34 | 44.23 | 3.88 | 1.42 | 1.7735 | 5.9 | 5.35 |
| 615 | 22.10 | 43.57 | 2.99 | 1.49 | 1.3451 | 6.5 | 6.85 |
| 616 | 24.43 | 43.74 | 2.87 | 1.53 | 0.8324 | 5.7 | 5.15 |
| 617 | 25.62 | 43.70 | 3.05 | 3.05 | 0.5975 | 5.6 | 6.15 |

Referring to Table VIA, Heats 975 and 980 were prepared to exemplify, respectively, the 20Cb-3 brand and the INCOLOY 825 brand alloys described hereinabove. The compositions of Heats 975 and 980 are set forth in Table VIA except for small amounts of carbon, nitrogen, maganese, silicon, phosphorus, sulfur, cerium plus lanthanum and boron as indicated for Examples 1–44. In addition, Heat 975 contained 0.51 w/o niobium and Heat 980 contained 0.59 w/o titanium. Cold rolled annealed (CRA) and machine ground duplicate specimens of each of Heats 975 and 980 were prepared with crevices and tested in 6 w/o $FeCl_3$ for 72 hours at room temperature (RT) (ASTM G48). The results as the average of the two tests are also set forth in Table VIA in mg/cm².

TABLE VIA

| Heat | Cr | Ni | Mo | Cu | Cor. I | Cor. II | Wt. Loss (mg/cm²) CRA, RT Crevice |
|---|---|---|---|---|---|---|---|
| 975 | 19.73 | 32.46 | 2.25 | 3.22 | 1.5765 | 8.0 | 21.70 |
| 980 | 21.46 | 42.00 | 2.97 | 1.88 | 1.4260 | 6.9 | 15.05 |

Heats 975 and 980 demonstrated good intergranular corrosion resistance (as measured in boiling 65 w/o $HNO_3$, ASTM A262-C) as was to be expected as indicated by the values of Cor. I for each. However, the crevice corrosion resistance in room temperature 6 w/o $FeCl_3$ leaves much to be desired as was also to be expected from the values of Cor. II.

Heats 613, 614 and 618–626 are within the ranges set forth in Table I and demonstrate that consistently good intergranular corrosion resistance (as measured in boiling 65 w/o $HNO_3$, ASTM A262-C) is not provided unless the alloy is balanced so as to satisfy the condition that the value of Correlation I be equal to or less than 1.6021. The composition of each of the Heats 618–626 is set forth in Table VII except for small amounts of carbon, nitrogen, manganese, silicon, phosphorus, sulfur, cerium plus lanthanum and boron as indicated for Examples 1–44. The composition of Heats 613 and 614 are repeated in Table VII for convenience. Cold rolled annealed (CRA) and machine ground duplicate specimens of each of Heats 613, 614 and 618–626 were prepared, sensitized and tested in boiling 65 w/o nitric acid as described in connection with Examples 1–44. The average corrosion rates were determined and are set forth in Table VII in millimeters per year (mmpy).

TABLE VII

| Heat No. | Cr | Ni | Mo | Cu | Cor. I | Cor. II | Cor. Rate (mmpy) Boiling $HNO_3$ |
|---|---|---|---|---|---|---|---|
| 613 | 20.05 | 43.69 | 3.01 | 1.40 | 1.8129 | 7.4 | 1.668 |
| 614 | 20.34 | 44.23 | 3.88 | 1.42 | 1.7735 | 5.9 | 2.070 |
| 618 | 20.17 | 33.85 | 5.00 | 2.86 | 1.7231 | 3.4 | 2.113 |
| 619 | 19.95 | 39.08 | 3.96 | 0.52 | 1.6397 | 4.9 | 1.059 |
| 620 | 20.07 | 39.16 | 5.00 | 0.55 | 1.7520 | 3.2 | 1.412 |
| 621 | 20.09 | 39.30 | 5.06 | 1.36 | 1.7861 | 3.5 | 1.524 |
| 622 | 20.53 | 39.02 | 4.81 | 2.98 | 1.6844 | 4.4 | 1.257 |
| 623 | 20.20 | 43.99 | 5.00 | 1.45 | 1.9014 | 4.2 | 2.686 |
| 624 | 20.11 | 44.15 | 3.16 | 2.87 | 1.8619 | 8.1 | 4.966 |
| 625 | 19.98 | 44.14 | 3.99 | 2.75 | 1.8957 | 6.7 | 6.553 |
| 626 | 20.70 | 44.13 | 4.82 | 2.90 | 1.8119 | 5.1 | 1.388 |

From the foregoing, it is apparent that when the elements Cr—Ni—Mo—Cu are balanced within the ranges of Table I in accordance with the present invention, an unexpected and desirable condition of corrosion resistance properties is provided with a high degree of consistency. The alloy is also characterized by good mechanical properties. Those results are confirmed by a substantial amount of additional data not considered necessary to be set forth herein. The alloy of the present invention is well suited for a wide variety of uses and can be readily produced in many convenient forms.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An austenitic stainless corrosion resistant alloy having good resistance to pitting and crevice corrosion in oxidizing chloride-bearing media combined with resistance to general corrosion and to intergranular corrosion in oxidizing media, said alloy consisting essentially in weight percent of about

| | w/o |
|---|---|
| C | 0.06 Max. |
| Mn | 1.4 Max. |
| Si | 0.9 Max. |
| P | 0.035 Max. |
| S | 0.035 Max. |
| Cr | 20–26 |
| Ni | 34–44 |
| Mo | 3–<5.1 |
| Cu | 0.1–<3.1 |
| N | 0.4 Max. |
| B | 0.005 Max. |
| Ce + La | 0.4 Max. Added |
| Nb | 1 Max. |
| Ti | 0.5 Max. |

the amount of nitrogen being not greater than that which can be retained in solution, the amount of cerium plus lanthanum being the amount added, niobium plus titanium when present ranging from a minimum which is sufficient to combine stoichiometrically with the amount of carbon present in excess of 0.025 w/o, the balance being essentially iron, and in which the elements chromium, nickel, molybdenum and copper are balanced so that the value of Correlation I is equal to or less than 1.6021 and the value of Correlation II is equal to or less than 5, Correlation I being defined as $$7.0011-0.2269(\%\ Cr)-0.0769(\%\ Ni)-0.046(\%\ Mo)+0.03(\%\ Cu)+0.0017(\%\ Ni)^2+0.0486(\%\ Mo)^2-0.0066(\%\ Ni)(\%\ Mo),$$

and Correlation II being defined as $$14.7182-0.3759(\%\ Cr)+0.0986(\%\ Ni)-1.2976(\%\ Mo)+0.02(\%\ Cu)-0.0165(\%\ Cr)(\%\ Mo)-0.0202(\%\ Cr)(\%\ Cu)+0.0223(\%\ Ni)(\%\ Cu).$$

2. The alloy set forth in claim 1 in which carbon is equal to or less than about 0.04 w/o and the amount of niobium plus titanium is such that $$\frac{w/o\ Nb}{10}+\frac{w/o\ Ti}{5}$$

is equal to or less than 0.03.

3. The alloy set forth in claim 1 which contains an amount of niobium plus titanium such that the value of $$\frac{w/o\ Nb}{10}+\frac{w/o\ Ti}{5}$$

ranges from about the weight percent of carbon in excess of 0.025 to about the total weight percent of carbon present.

4. The alloy set forth in claim 1 in which when carbon is greater than 0.03 w/o the minimum amount of niobium plus titanium present is such that $$\frac{w/o\ Nb}{10}+\frac{w/o\ Ti}{5}$$

is at least about equal to the weight percent of carbon.

5. The alloy set forth in claim 1 in which carbon is not more than 0.03 w/o.

6. The alloy set forth in claim 1 which contains and about 0.4–2 w/o copper.

7. The alloy set forth in claims 1, 2, 3, 4, 5 or 6 which contains about 0.5 w/o Max. manganese, 0.4 w/o Max. silicon and 0.05 w/o Max. nitrogen.

8. The alloy set forth in claim 7 which contains about 22.5–24 w/o chromium, and about 37–43 w/o nickel.

9. The alloy set forth in claim 7 which contains about 22.5–24 w/o chromium, and about 37–41.5 w/o nickel.

10. The alloy set forth in claim 7 which contains about 22.5–24 w/o chromium, about 37–41.5 w/o nickel, about 3.5–4.5 w/o molybdenum, and about 0.5–1.5 w/o copper.

11. The alloy set forth in claim 10 which contains about 0.025 Max. phosphorus, about 0.005 Max. sulfur, and about 0.0015–0.0035 w/o boron.

12. The alloy set forth in claim 1 which contains about 0.025 w/o Max. carbon, and about 0.2–0.3 w/o niobium.

13. The alloy set forth in claim 1 which contains about 0.023 w/o C, 0.30 w/o Mn, 0.36 w/o Si, 0.024 w/o P, 0.004 w/o S, 23.46 w/o Cr, 37.59 w/o Ni, 3.76 w/o Mo, 1.16 w/o Cu, 0.0017 w/o B, 0.035 w/o N, and 0.27 w/o Nb.

14. A weld filler material having as-welded good resistance to pitting and crevice corrosion in oxidizing chloride-bearing media combined with resistance to general corrosion and to intergranular corrosion in oxidizing media, consisting essentially in weight percent of about

| | w/o |
|---|---|
| C | 0.06 Max. |
| Mn | 1.4 Max. |
| Si | 0.9 Max. |
| P | 0.035 Max. |
| S | 0.035 Max. |
| Cr | 22.5–26 |
| Ni | 38–44 |
| Mo | 4–<5.1 |
| Cu | 0.4–2 |
| N | 0.4 Max. |
| B | 0.005 Max. |
| Ce + La | 0.3 Max. Added |
| Nb | 1 Max. |
| Ti | 0.5 Max. |

the amount of nitrogen being not greater than that which can be retained in solution, the amount of cerium plus lanthanum being the amount added, niobium plus titanium when present ranging from a minimum which is sufficient to combine stoichiometrically with the amount of carbon present in excess of 0.025 w/o, the balance being essentially iron, and in which the elements chromium, nickel, molybdenum and copper are balanced so that the value of Correlation I is equal to or less than 1.6021 and the value of Correlation II is equal to or less than 5, Correlation I being defined as $$7.0011-0.2269(\%\ Cr)-0.0769(\%\ Ni)-0.046(\%\ Mo)+0.03(\%\ Cu)+0.0017(\%\ Ni)^2+0.0486(\%\ Mo)^2-0.0066(\%\ Ni)(\%\ Mo),$$

and Correlation II being defined as $$14.7182-0.3759(\%\ Cr)+0.0986(\%\ Ni)-1.2976(\%\ Mo)+0.02(\%\ Cu)-0.0165(\%\ Cr)(\%\ Mo)-0.0202(\%\ Cr)(\%\ Cu)+0.0223(\%\ Ni)(\%\ Cu).$$

15. The weld filler material set forth in claim 14 which contains about

| | w/o |
|---|---|
| Cr | 22.5–24 |
| Ni | 41.5–43 |
| Mo | 4.5–<5.1 |

-continued

| | w/o |
|---|---|
| Cu | 0.5–2 |

16. The weld filler material set forth in claim 15 which contains

| | w/o |
|---|---|
| C | 0.015 Max |
| Mn | 0.5 Max |
| Si | 0.20 Max. |
| P | 0.020 Max. |
| S | 0.005 Max. |
| Nb | 0.3 Max |

17. The weld filler material set forth in claims 15 and 16 which contains about 0.05 w/o Max. nitrogen, and about 0.0015–0.0035 w/o boron.

18. A welded austenitic stainless corrosion resistant article at least the welded portion of which is made of an alloy having as-welded good resistance to pitting and crevice corrosion in oxidizing chloride-bearing media combined with resistance to general corrosion and to intergranular corrosion in oxidizing media, said alloy consisting essentially in weight percent of about

| | w/o |
|---|---|
| C | 0.06 Max. |
| Mn | 1.4 Max. |
| Si | 0.9 Max. |
| P | 0.035 Max. |
| S | 0.035 Max. |
| Cr | 22.5–26 |
| Ni | 38–44 |
| Mo | 4–<5.1 |
| Cu | 0.4–2 |
| N | 0.4 Max. |
| B | 0.005 Max. |
| Ce + La | 0.3 Max. Added |
| Nb | 1 Max. |
| Ti | 0.5 Max. |

the amount of nitrogen being not greater than that which can be retained in solution, the amount of cerium plus lanthanum being the amount added, niobium plus titanium when present ranging from a minimum which is sufficient to combine stoichiometrically with the amount of carbon present in excess of 0.025 w/o, the balance being essentially iron, and in which the elements chromium, nickel, molybdenum and copper are balanced so that the value of Correlation I is equal to or less than 1.6021 and the value of Correlation II is equal to or less than 5, Correlation I being defined as $$7.0011-0.2269(\%\ Cr)-0.0769(\%\ Ni)-0.046(\%\ Mo)+0.03(\%\ Cu)+0.0017(\%\ Ni)^2+0.0486(\%\ Mo)^2-0.0066(\%\ Ni)(\%\ Mo),$$

and Correlation II being defined as $$14.7182-0.3759(\%\ Cr)+0.0986(\%\ Ni)-1.2976(\%\ Mo)+0.02(\%\ Cu)-0.0165(\%\ Cr)(\%\ Mo)-0.0202(\%\ Cr)(\%\ Cu)+0.0223(\%\ Ni)(\%\ Cu).$$

19. The welded article as set forth in claim 18 in which said alloy contains about

| | w/o |
|---|---|
| Cr | 22.5–24 |
| Ni | 41.5–43 |

-continued

| | w/o |
|---|---|
| Mo | 4.5-<5.1 |
| Cu | 0.5-2. |

20. The welded article set forth in claim 19 made from an alloy which contains

| | w/o |
|---|---|
| C | 0.015 Max |

-continued

| | w/o |
|---|---|
| Mn | 0.5 Max |
| Si | 0.20 Max. |
| P | 0.020 Max. |
| S | 0.005 Max. |
| Nb | 0.3 Max |

21. The welded article set forth in claim 19 made from an alloy which contains about 0.05 w/o Max. nitrogen, and about 0.0015-0.0035 w/o boron.

22. The welded article set forth in claim 20 made from an alloy which contains about 0.05 w/o Max. nitrogen, and about 0.0015-0.0035 w/o boron.

* * * * *